United States Patent [19]

Satou et al.

[11] Patent Number: 4,998,140

[45] Date of Patent: Mar. 5, 1991

[54] DEVELOPING DEVICE FOR COPIER WITH SEALING MEANS

[75] Inventors: Kazuhiro Satou; Hisashi Kunihiro, both of Nara; Akio Shiomi, Kyoto; Naotaka Funayama, Nara; Hideaki Hagihara, Nara, all of Japan

[73] Assignee: Sharp Kabushiki Kaisha, Osaka, Japan

[21] Appl. No.: 233,146

[22] Filed: Aug. 17, 1988

[30] Foreign Application Priority Data

Sep. 17, 1987 [JP] Japan ..... 62-142861[U]

[51] Int. Cl.[5] ..... G03G 15/06

[52] U.S. Cl. ..... 355/245; 355/253; 118/656

[58] Field of Search ..... 355/245, 260, 251, 252; 206/316.1; 222/DIG. 1; 352/130; 118/657–658

[56] References Cited

U.S. PATENT DOCUMENTS

| | | | |
|---|---|---|---|
| 4,003,064 | 1/1977 | Mason | 352/130 |
| 4,237,943 | 4/1979 | Ermel et al. | 222/DIG. 1 |
| 4,492,321 | 1/1985 | Zoltner | 222/DIG. 1 |
| 4,614,286 | 6/1983 | Yamaguchi et al. | 222/DIG. 1 |
| 4,732,277 | 1/1987 | Smith | 355/260 |
| 4,799,608 | 1/1989 | Oka | 222/DIG. 1 |

FOREIGN PATENT DOCUMENTS

| | | | |
|---|---|---|---|
| 0276532 | 12/1987 | Japan | 355/75 |

*Primary Examiner*—R. L. Moses

*Attorney, Agent, or Firm*—Flehr, Hohbach, Test, Albritton & Herbert

[57] ABSTRACT

A developing device for an electrophotographic copier has a supply tank above a developing tank with an opening therebetween. A sealing member is removably attached to the rims of this opening before the developing device is ready to be used. An end part of this sealing member is attached to a take-up shaft and the sealing member is pulled or peeled off to be wound around the take-up shaft when the developing device is set in the copier and the shaft becomes connected to a motor in the copier.

13 Claims, 7 Drawing Sheets

FIG._6A
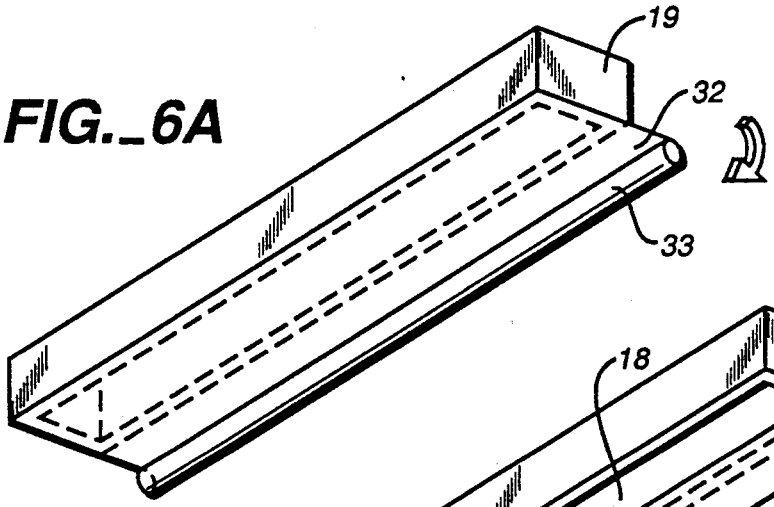
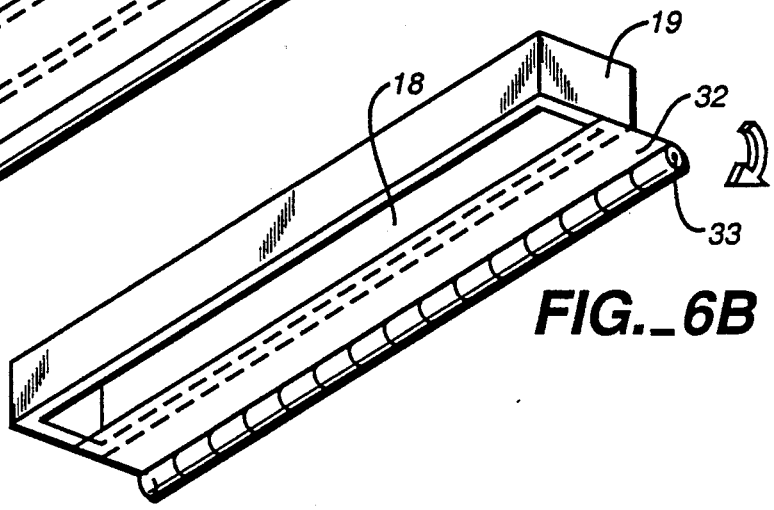
FIG._6B
FIG._5
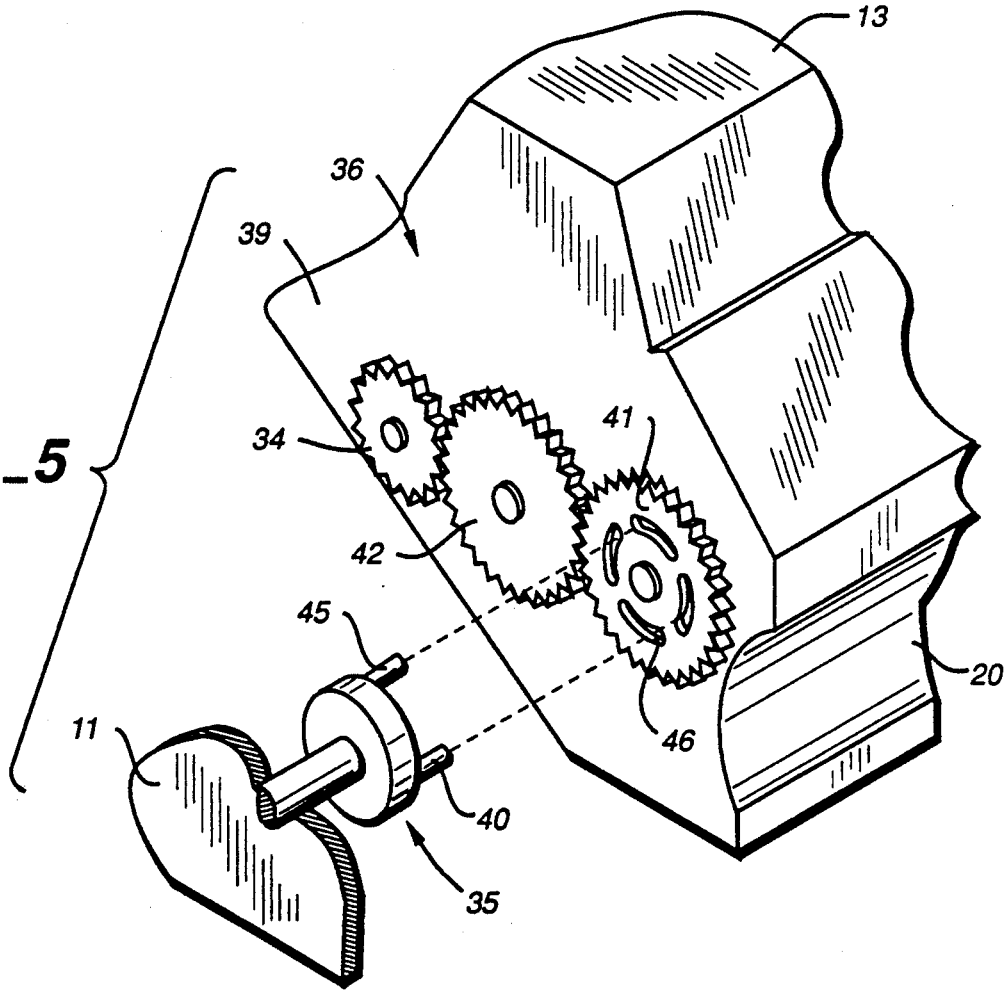

FIG._9A
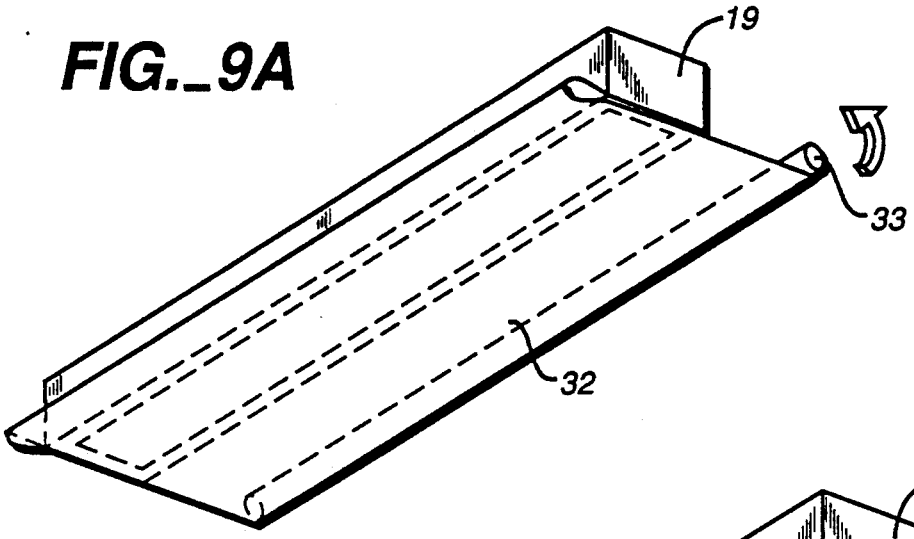
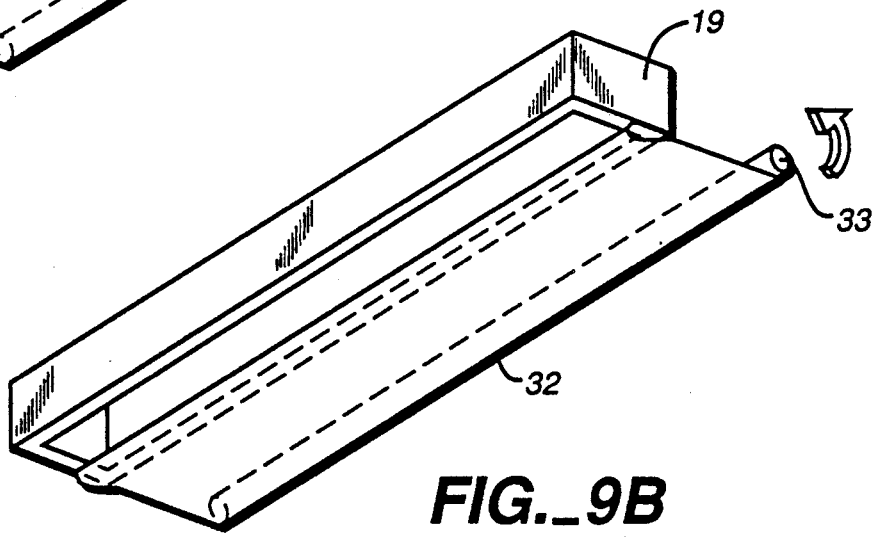
FIG._9B
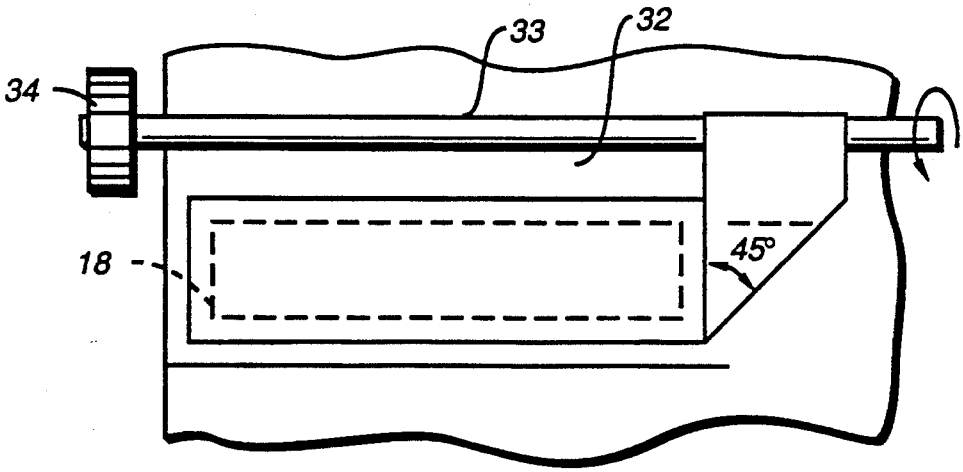
FIG._10

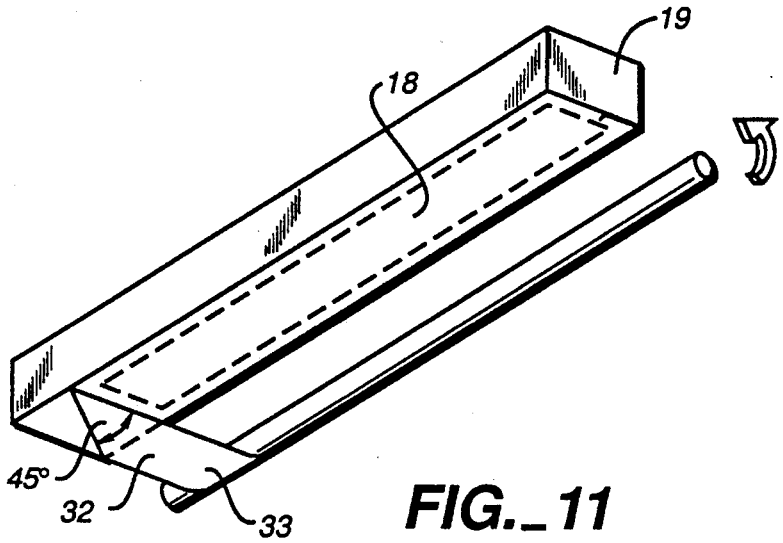
FIG._11
FIG._12
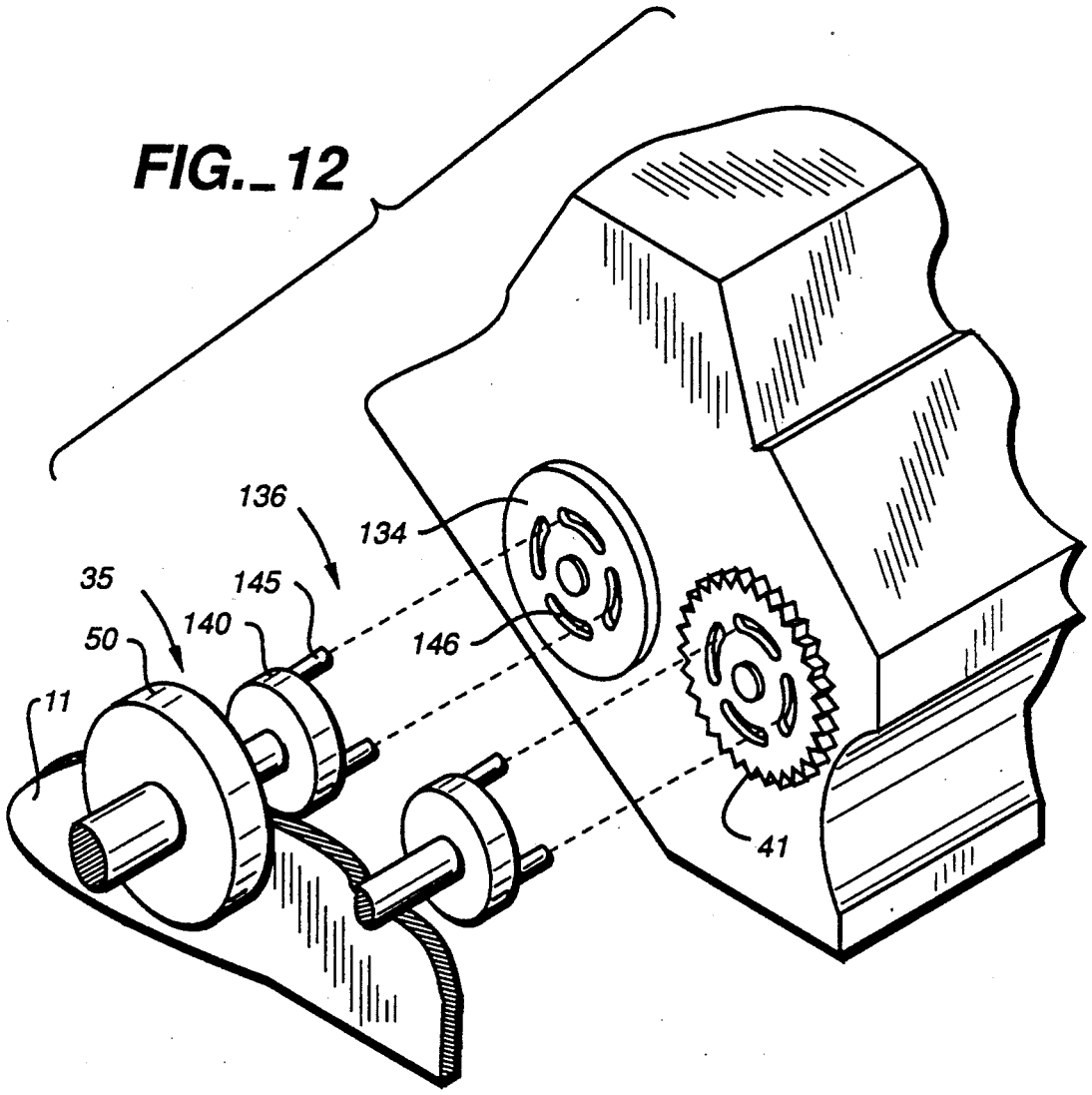

DEVELOPING DEVICE FOR COPIER WITH SEALING MEANS

BACKGROUND OF THE INVENTION

This invention relates to a developing device for an electrophotographic copier, a laser printer and the like and more particularly to a developing device composed of a developing tank and a supply tank having an improved sealing means for sealing the supply outlet of the supply tank through which developing agent drops into the developing tank.

A developing device for a copier is detachably attached near the copier's photoreceptor and is comprised of a developing tank and a supply tank having a supply outlet through which developing agent is supplied into the developing tank. Since the developing tank itself is also provided with an opening through which toner can be applied to the photoreceptor, if the copier has its developing device filled with developing agent, it is difficult to prevent the developing agent from spilling out when the copier is transported. For this reason, a copier is shipped without any developing agent at all in the developing device or by closing the supply outlet with a removable sealing material and putting developing agent only in the supply tank. Such a sealing material is removed by the user when the copier is set and is ready to be used. FIGS. 1A and 1B show a prior art sealing means 3 used for such a purpose with one end 4 extending forward from the outlet 2 of the supply tank 1. After the copier is set, the user must pull the end 4 to remove the sealing means 3 from the supply outlet 2, but the surface of the sealing means 3 is usually covered with developing agent even after it is removed from the supply tank 1. The user usually finds it difficult to keep his or her hands clean after removing the sealing means 3. Another disadvantage of such prior art sealing means is that the user may forget to remove it before beginning to use the copier.

SUMMARY OF THE INVENTION

It is therefore an object of the present invention to provide a developing device for a copier with an improved sealing member for sealing its toner supply opening and more particularly to a developing device from which the sealing member can be easily and automatically removed.

A developing device with which the above and other objects can be achieved has a supply tank for containing toner above a developing tank with an opening therebetween to be sealed before the developing device is ready to be used. A sealing member removably attached to the rims of the opening is pulled by rotating a take-up shaft to which one of its ends is attached and wound therearound inside a closed chamber. Rotation of the take-up shaft is made easier if the sealing member is so extended from the area of the opening to be covered that it is peeled rather than pulled. According to one embodiment of the present invention, the extended part of the sealing member is led away from the take-up shaft, folded back toward it and attached to its surface area. According to another embodiment, it is led sideways and folded approximately by 45° to make a 90°-turn to be wound around a take-up shaft of which the side surface may be tapered. If a detector connected to a timer is provided for detecting the rear end of the sealing member which is being wound around the take-up shaft and a clutch in the power-communicating means to be controlled by such a timer, the take-up shaft can be prevented from continuing to rotate after the sealing member is completely removed.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings:

FIG. 5 is a diagonal view of the motion-communicating gear system of the developing device of FIGS. 2, 3 and 4, FIGS. 6A and 6B are diagonal views of the toner supply opening of the developing device shown in FIGS. 2–5 as its sealing member is being removed, FIGS. 9A and 9B are diagonal views of the toner supply opening of the developing device of FIGS. 7 and 8 as its sealing member is being removed, FIG. 10 is a drawing showing another manner in which the sealing member may be attached to the take-up shaft, FIG. 11 is a diagonal view of another take-up shaft, FIG. 12 is a diagonal view of the motion-communicating connecting means of still another developing device embodying the present invention.

In all these figures, components which are identical or function similarly are denoted by numerals with the same two lower digits.

DETAILED DESCRIPTION OF THE INVENTION

Figure 1A:
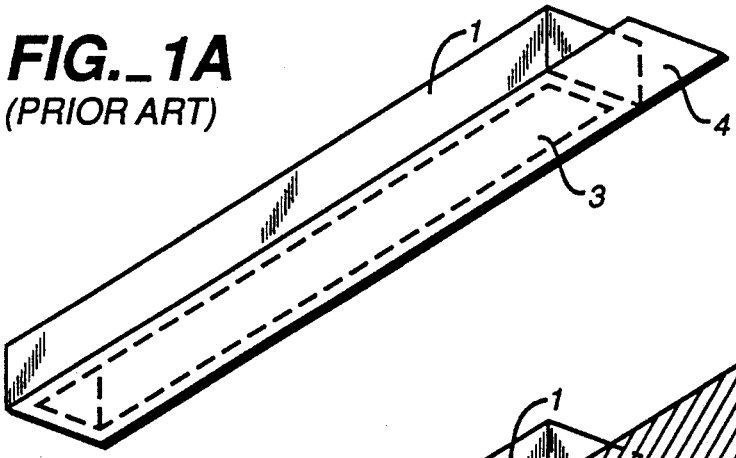
FIG. 1A (PRIOR ART)
FIGS. 1A and 1B are diagonal views of a toner supply opening provided with a prior art sealing member.
Figure 1B:
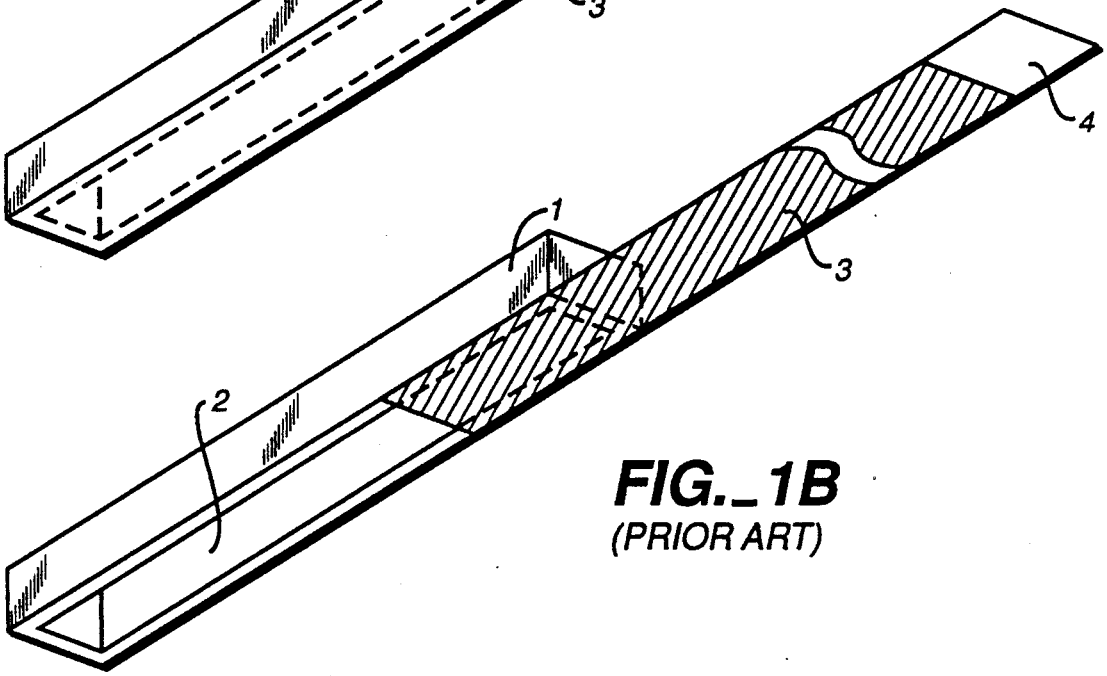
FIG. 1B (PRIOR ART)
Figure 2:
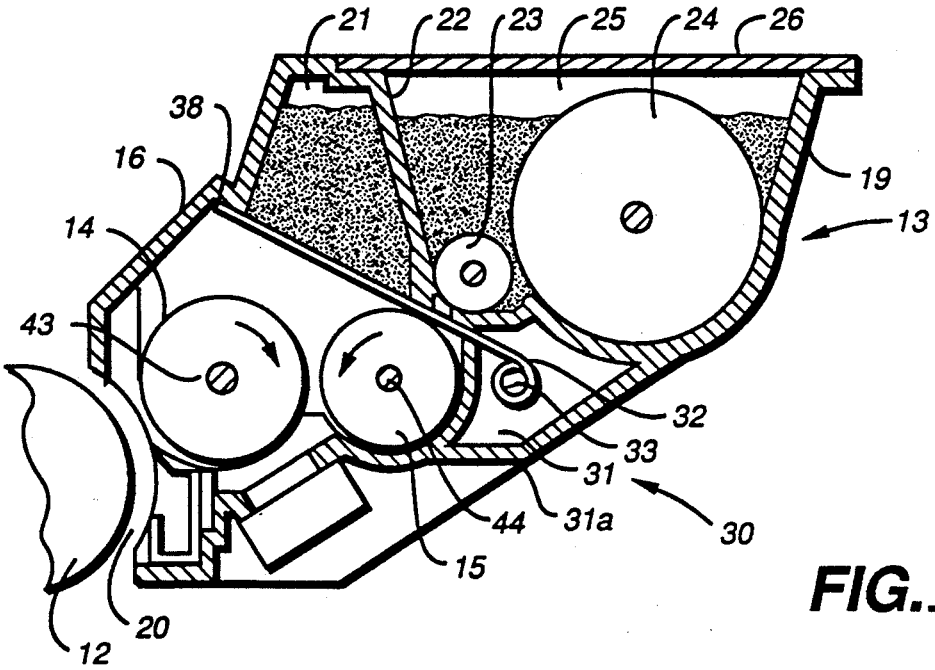
FIGS. 2 and 3 are schematic frontal sectional views of a developing device embodying the present invention when its sealing member is fully attached and being removed, respectively.
Figure 3:
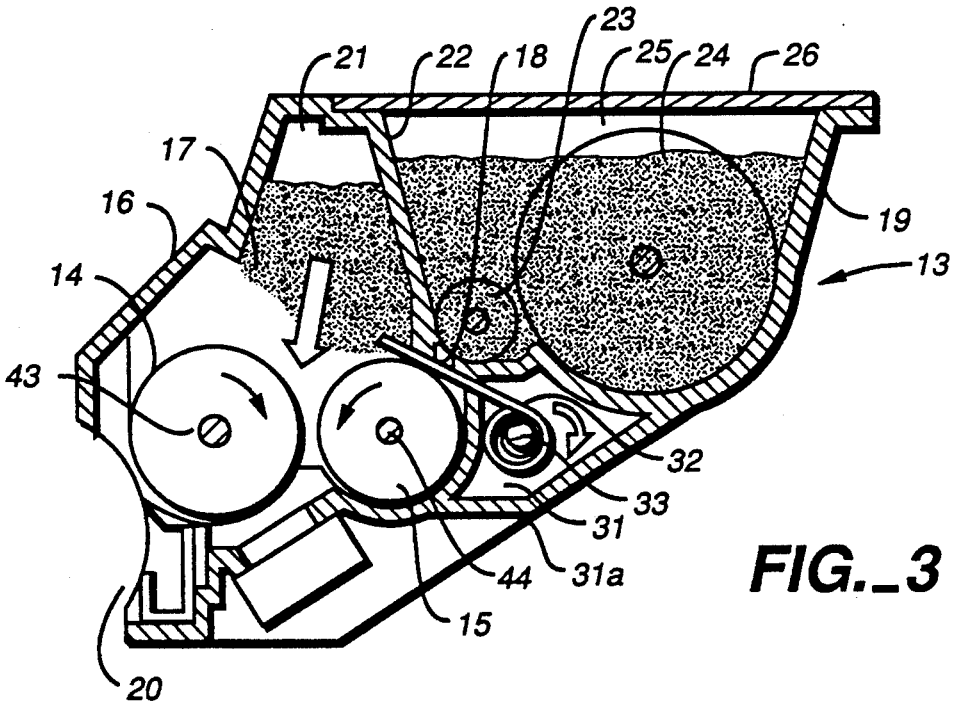
Figure 4:
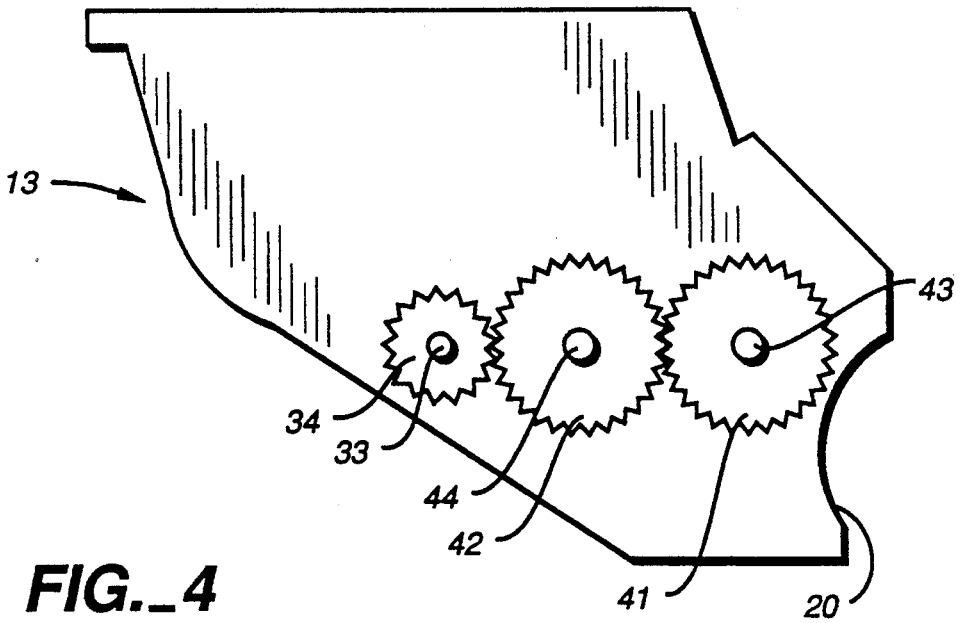
FIG. 4 is a back view of the developing device of FIGS. 2 and 3.

A developing device for a copier according to one embodiment of the present invention is explained first by way concurrently of FIGS. 2 and 3 which are its frontal sectional views when its sealing means is fully attached and being removed, respectively, FIG. 4 which is its back view, FIG. 5 which is a diagonal view of its gears at the back and FIGS. 6A and 6B which are diagonal views of the supply outlet of the supply tank when it is sealed and being opened, respectively. Briefly described, numeral 13 indicates the developing device, or the main body thereof detachably attached to the main structure 11 of the copier near its photoreceptor 12 comprised of a developing tank 16 containing a developer roller 14 and a stirrer roller 15 and a supply tank 19 having supply outlets 17 and 18 through which developing agent is supplied into the developing tank 16. The developing tank 16 is shaped like a box with an open top. The developer roller 14 is rotatably supported near an opening 20 through which toner is applied to the photoreceptor 12 and the stirrer roller 15 is disposed farther away from the photoreceptor 12 than the developer roller 14.

As shown both in FIGS. 2 and 3, the supply tank 19 is unistructurally formed with the developing tank 16 and includes a storage chamber 21 formed above the developing tank 16 for storing developing agent (both toner and carrier) therein and a toner supply chamber 25 which is adjacent to the storage chamber 21 and separate therefrom by a partition wall 22. The toner supply chamber 25 contains a toner supply roller 23 and a toner stirrer roller 24 and is on the opposite side of the storage chamber 21 away from the photoreceptor 12. Both the storage chamber 21 and the toner supply chamber 25 have a bottom opening 17 or 18 leading to the developing tank 16. At the bottom opening 18 of the toner supply chamber 25 is the toner supply roller 23 supported rotatably. The toner stirrer roller 24 is disposed farther away from the photoreceptor 12 than the toner supply roller 23. A lid 26 is provided at the top of the toner supply chamber 25.

Sealing means for sealing the bottom openings 17 and 18 of the storage chamber 21 and the toner supply chamber 25 are shown at 30 and include a take-up chamber 31 formed next to the developing tank 16 and the supply tank 19 in the main body 13 by a wall 31*a*, a film-like sealing member 32 which is removably attached to the rims of the bottom openings 17 and 18 of the storage chamber 21 and the toner supply chamber 25 and of which an end is disposed inside the aforementioned take-up chamber 31, a take-up shaft 33 rotatably supported inside the take-up chamber 31 for winding up the sealing member 32, a take-up gear 34 serving as a driving means for rotating the take-up shaft 33 and connecting means 36 for connecting the take-up gear 34 to driving means 35 in the main copier structure 11 when the developing device 13 is installed in the copier 11.

The take-up chamber 31 is situated farther away from the photoreceptor 12 than the stirrer roller 15 in the developing tank 16 and below the toner supply roller 23 in the supply tank 19. An inlet 37 for pulling the sealing member 32 therethrough into this take-up chamber 31 is formed in the boundary wall of the take-up chamber 31 with the developing tank 16 and the supply tank 19. The rims around the bottom opening 17 of the storage chamber 21 have a flat section 38 sloping in the direction of the inlet 37 and the bottom surface of the partition wall 22 forms a portion of the rims around the openings 17 and 18. The rims around the bottom opening 18 of the toner supply chamber 25 continue into the aforementioned inlet 37 leading into the take-up chamber 31. The sealing member 32 is removably attached to the rims of the openings 17 and 18 of the storage chamber 21 and the toner supply chamber 25 with one end passing through the inlet 37 and affixed to the side surface of the take-up shaft 33. The take-up shaft 33 is rotatably supported inside the take-up chamber 31 and its back end penetrates the back wall 39 as shown in FIG. 5. The aforementioned take-up gear 34 is attached to the take-up shaft 33 outside this back wall.

The aforementioned connecting means 36 include a developer gear 41 which engages with a driver ring 40 attached to the main structure 11 of the copier to drive the developer roller 14 and a stirrer gear 42 engaging with the developer gear 41 and the take-up gear 34. The developer gear 41 is affixed to the end of the shaft 43 of the developer roller 14 which penetrates the back wall of the developing tank 16. The stirrer gear 42 is similarly affixed to the end of the shaft 44 of the stirrer roller 15 which also penetrates the back wall of the developing tank 16. As shown in FIG. 5, there are pins 45 protruding from the driver ring 40 and removably engaged in holes formed on the opposite surface of the developer gear 41. Although not shown in FIG. 5, what was referred to above as the driving means 35 in the main structure 11 of the copier include a motor and the aforementioned driver ring 40 rotated by this motor. When the copier 11 is transported, the bottom openings 17 and 18 of the supply tank 19 are sealed by the sealing member 32 as shown in FIG. 2. The developing tank 16 does not contain any developing agent. With the bottom openings 17 and 18 thus sealed, the developing agent does not drop into the developing tank 16 or spill out through the opening 20 while the copier is transported.

When the copier is ready to be used and the developing device 13 is set in the copier main structure 11, the pins 45 engage in the corresponding holes in the developer gear 46. If power is switched on thereafter, the driver ring 40 begins to rotate and this motion is communicated through the developer gear 41 and the stirrer gear 42 to the take-up gear 34. As a result, the take-up shaft 33 begins to rotate, winding up the sealing member 32 therearound. The sealing member 32 is thereby removed from the bottom openings 17 and 18 of the supply tank 19 and pulled into the take-up chamber 31. This allows the developing agent (both toner and carrier) to drop from the storage chamber 21 and the toner from the toner supply chamber 25.

In summary, the developer roller 14 must necessarily be rotated for copying but since the motion of the developer roller 14 is communicated to the take-up shaft 33, the sealing member 32 is automatically removed even if the user forgets to do so. Although toner and developing agent are attached to the sealing member 32 when the removed sealing member 32 is wound up around the take-up shaft 33, furthermore, they do not make the user's hands or nearby copier parts dirty because the sealing member 32 is neatly taken up into the take-up chamber 31 which is sealed.

The foregoing description of a preferred embodiment of the invention has been presented for purposes of illustration and description. It is not intended to be exhaustive or to limit the invention to the precise form disclosed and many modifications and variations are possible in light of the above teaching. For example, the connecting means 36 need not be formed with gears as disclosed above. Instead, a driver gear may be provided to the copier main structure 11 such that the take-up gear 34 is directly engaged therewith. Instead of gears, use may also be made of a belt to communicate motion. Moreover, the supply tank 19 need not include two chambers. The present invention is equally applicable to a developing device having only a toner supply chamber.

Figure 7:
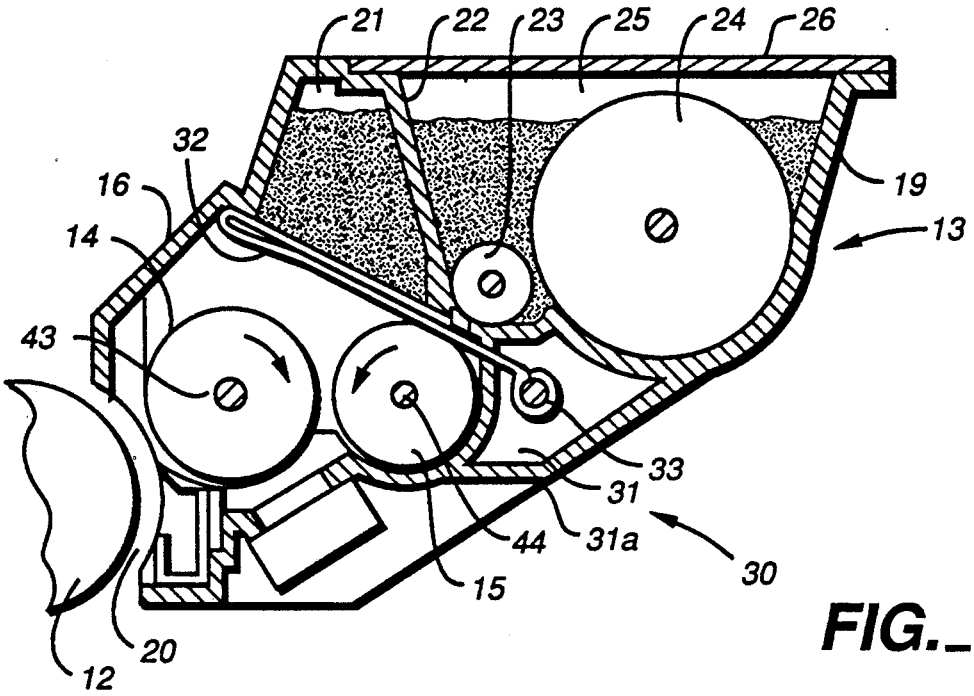
FIGS. 7 and 8 are schematic frontal sectional views of another developing device embodying the present invention when its sealing member is fully attached and being removed, respectively.
Figure 8:
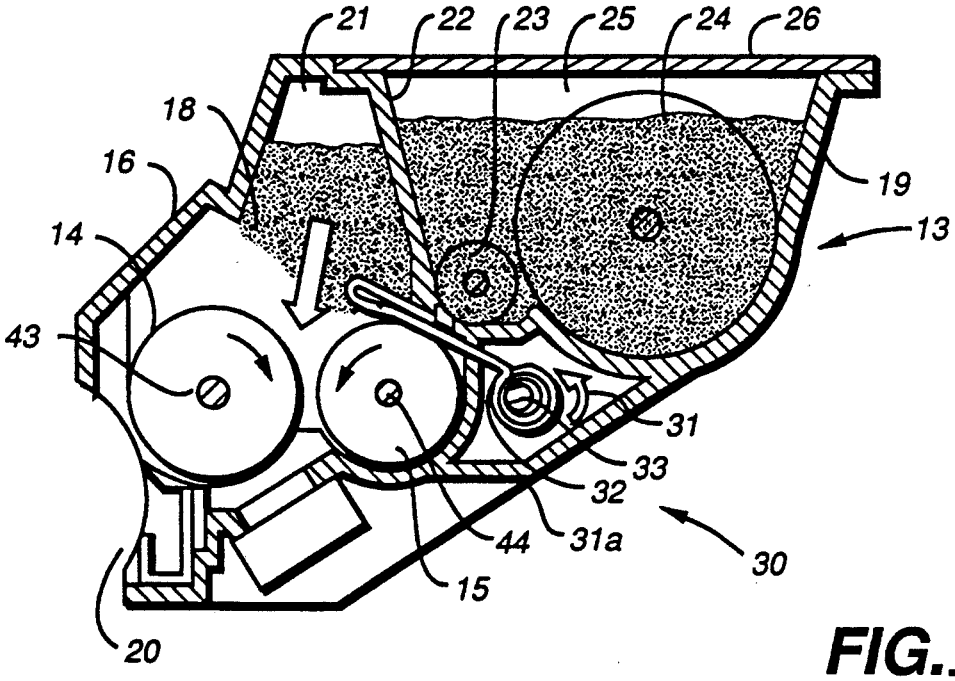

FIGS. 7 and 8 show another developing device embodying the present invention which is similar to the one described above by way of FIGS. 2–5, 6A and 6B except the sealing member 32 is attached to the take-up shaft 33 in a different manner. The sealing member 32 in FIGS. 7 and 8 is extended from the area covering the openings 17 and 18 not directly in the direction of the take-up shaft 33 but initially away therefrom and then folded back to be led into the take-up chamber 31 and to be wrapped around the take-up shaft 33. In this manner, the sealing member 32 is peeled off as shown in FIGS. 9A and 9B rather than pulled off as in the previous example shown in FIGS. 6A and 6B. Thus, it takes less power to rotate the take-up shaft 33 to remove the sealing member 33.

FIG. 10 shows still another way the sealing member 32 covering the openings 17 and 18 may be attached to and removed by the take-up shaft 33. According to this embodiment, the sealing member 32 is extended from the area covering the openings 17 and 18 not in the direction of the take-up shaft 33 as shown in FIGS. 2 and 3 or away therefrom as shown in FIGS. 7 and 8 but in the direction parallel to the take-up shaft 33 (that is, in the longitudinal or axial direction) and then folded at an angle of about 45° to make a 90°-turn towards the take-up shaft 33 to be wrapped therearound. As the take-up shaft 33 is rotated, the sealing member 32 is diagonally peeled off the rims of the openings 17 and 18 while remaining folded at about 45°. This method of attaching the sealing member 32 to the take-up shaft 33 is also advantageous in that the torque required to rotate the take-up shaft 33 can be reduced and stabilized.

FIG. 11 shows still another sealing means 30 embodying the present invention characterized as having the sealing member 32 attached to the take-up shaft 33 by extending longitudinally and then folding to make an approximately 90°-turn just as disclosed above in connection with FIG. 10 except the take-up shaft 33 is not cylindrical with the same diameter throughout its length but is a rod of which the diameter decreases uniformly from one end to the other end where the extended part of the sealing member 32 is attached. With the take-up shaft 33 thus having a tapered surface, the torque thereon can be reduced and stabilized.

In all exemplary developing devices embodying the present invention disclosed above, the sealing member 32 keeps rotating around the take-up shaft 33 inside the take-up chamber 31, once it is removed from its sealing position and wound up around the take-up shaft 33, whenever motion of the driving means 35 is communicated thereto through the connecting means 36. Rotation of the wound-up sealing member 32 may cause noise and scatter toner particles around although most do not fly out of the take-up chamber 31. In any event, there is no need to keep the take-up shaft 33 rotating after the sealing member 32 is removed and wound up therearound. By disconnecting the take-up shaft 33 from the driving means 35 after the sealing member 32 is removed, the load on the driving means 35 and the wear on the connecting means 36 can be reduced. FIGS. 12, 13, 14A and 14B show still another sealing means 130 with which the above and other objects can be achieved.

Figure 13:
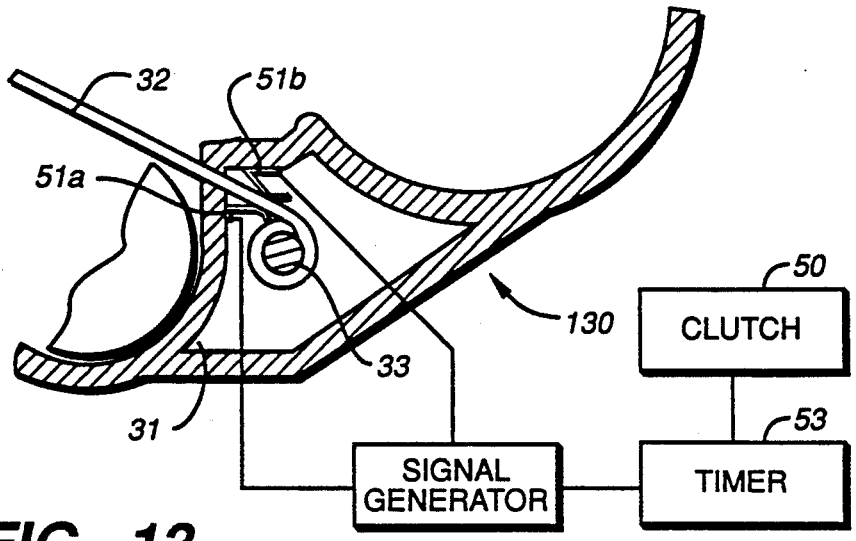
FIG. 13 is a schematic frontal sectional view of the take-up chamber of the developing device shown in FIG. 12, and FIGS. 14A and 14B are diagonal views of the toner supply opening of the developing device shown in FIGS. 12 and 13 as its sealing member is being removed.
Figure 14A:
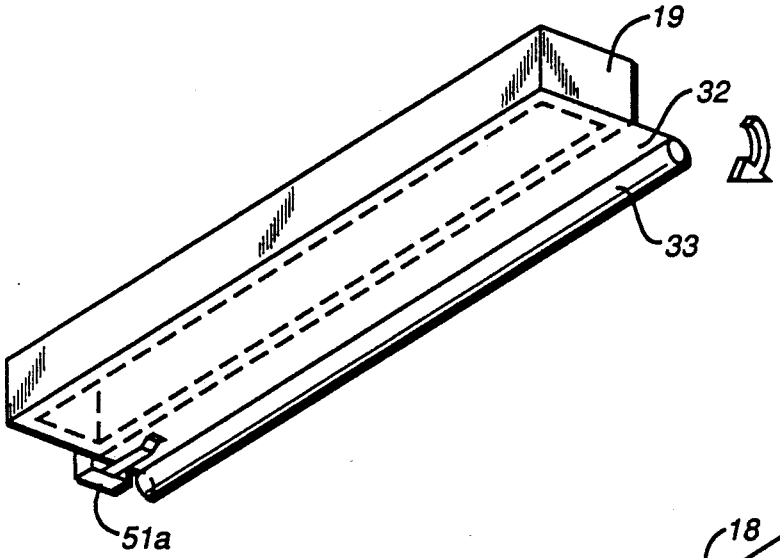
Figure 14B:
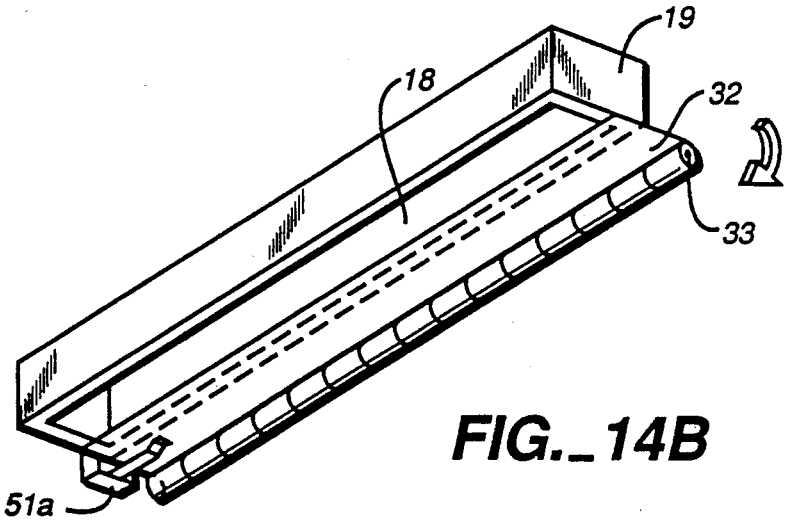

The sealing means 130 is different from the ones described above principally by the way power is communicated through its connecting means 136 to its take-up shaft 33. As shown in FIG. 12, the externally protruding end of the take-up shaft 33 has affixed thereto a coupler 134, instead of a gear for communicating motion with the stirrer roller 15. The coupler 134 has holes 146 as found on the developer gear 41 such that pins 145 protruding from a driver ring 140 connected through a clutch 50 to a motor (not shown) can engage therein to form a controllably power communicating relationship. As shown in FIG. 13, two metallic pieces **51*a* and 51*b* protrude to sandwich the sealing member 32 inside the take-up chamber 31. These two pieces 51*a* and 51*b* are biased toward each other and touch each other to close a circuit after the sealing member 32 is completely pulled inside the take-up chamber 31 and its rear end passes their position. When this occurs, a detection signal generator 52 transmits a signal to a timer 53 to operate the clutch 50 such that motor power is communicated to the take-up shaft 33 only for a preset length of time to remove the sealing member 32. FIGS. 14A and 14B show the position of the contact piece 51*a* with respect to the sealing member 32**.

In summary, the present invention is intended to be broadly construed. Such modifications and variations that may be apparent to a person skilled in the art are to be included within the scope of this invention.

What is claimed is:

1. In a developing device removably attachable to an electrophotographic apparatus, said developing device comprising a developing tank and a supply tank, said developing tank containing a developer roller and a stirrer roller, said supply tank having a supply opening with rims therearound for supplying developing agent into said developing tank therethrough, the improvement wherein said developing device further comprises sealing means for sealing said supply opening, said sealing means including a sealing member removably attached to said rims of said opening to sealingly cover said opening, a take-up shaft rotatably supported by said developing device and serving to wind said sealing member therearound, driving means for simultaneously rotating said take-up shaft, said developer roller and said stirrer roller, and connecting means for a connecting said driving means to a power source on said electrophotographic apparatus when said developing device is set to said electrophotographic apparatus.

2. In a developing device removably attachable to an electrophotographic apparatus, said developing device comprising a developing tank and a supply tank, said developing tank containing a developer roller and a stirrer roller, said supply tank having a supply opening with rims therearound for supplying developing agent into said developing tank therethrough, the improvement wherein said developing device further comprises sealing means for sealing said supply opening, said sealing means including a sealing member removably attached to said rims of said opening to sealingly cover said opening, a take-up shaft rotatably supported by said developing device and serving to wind said sealing member therearound, driving means for simultaneously rotating said take-up shaft, said developer roller and said stirrer roller and connecting means for connecting said driving means to a power source on said electrophotographic apparatus when said developing device is set to said electrophotographic apparatus, said sealing member having an end part which extends outward from said rims, said end part extending away from said take-up shaft, being folded back toward said take-up shaft and being attached to said take-up shaft.

3. In a developing device removably attachable to an electrophotographic apparatus, said developing device comprising a developing tank and a supply tank, said supply tank having a supply opening with rims therearound for supplying developing agent into said developing tank therethrough, the improvement wherein said developing device further comprises sealing means for sealing said supply opening, said sealing means including a sealing member removably attached to said rims of said opening to sealingly cover said opening, a take-up shaft rotatably supported by said developing device and serving to wind said sealing member therearound, driving means for rotating said take-up shaft, and connecting means for connecting said driving means to a power source on said electrophotographic apparatus when said developing device is set to said electrophotographic apparatus.

said sealing member having an end part which extends outward from said rims, said end part extending parallel to said take-up shaft, being folded approximately by 45° to make an approximately 90°-turn and being attached to said take-up shaft.

4. The developing device of claim 3 wherein said take-up shaft has a tapered surface.

5. The developing device of claim 1 further comprising detector means for transmitting a detection signal upon detecting that said sealing member has been totally removed from said rims, and control means for activating said driving means according to said detection signal.

6. The developing device of claim 5 wherein said control means serve to cause said take-up shaft to be operated only during a predefined length of time.

7. The developing device of claim 5 wherein said connecting means include a clutch which is controlled by said control means.

8. The developing device of claim 2 further comprising detector means for transmitting a detection signal upon detecting that aid sealing member has been totally removed from said rims, and control means for activating said driving means according to said detection signal.

9. The developing device of claim 3 further comprising detector means for transmitting a detection signal upon detecting that said sealing member has been totally removed from said rims, and control means for activating said driving means according to said detection signal.

10. The developing device of claim 8 wherein said control means serve to cause said take-up shaft to be operated only during a predefined length of time.

11. The developing device of claim 9 wherein said control means serve to cause said take-up shaft to be operated only during a predefined length of time.

12. The developing device of claim 8 wherein said connecting means include a clutch which is controlled by said control means.

13. The developing device of claim 9 wherein said connecting means include a clutch which is controlled by said control means.

* * * * *